US012668907B2

(12) United States Patent
Banta et al.

(10) Patent No.: US 12,668,907 B2
(45) Date of Patent: Jun. 30, 2026

(54) DETECT WASH ADDITIVES IN A WASHING MACHINE APPLIANCE

(71) Applicant: Haier US Appliance Solutions, Inc., Wilmington, DE (US)

(72) Inventors: Mark Banta, Pewee Valley, KY (US); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 98 days.

(21) Appl. No.: 18/403,302

(22) Filed: Jan. 3, 2024

(65) Prior Publication Data

US 2025/0215630 A1 Jul. 3, 2025

(51) Int. Cl.

| | |
|---|---|
| ***D06F 34/22*** | (2020.01) |
| ***D06F 23/04*** | (2006.01) |
| ***D06F 33/37*** | (2020.01) |
| ***D06F 33/38*** | (2020.01) |
| ***D06F 34/04*** | (2020.01) |
| ***D06F 34/28*** | (2020.01) |
| ***D06F 39/02*** | (2006.01) |
| *D06F 103/22* | (2020.01) |
| *D06F 105/42* | (2020.01) |
| *D06F 105/52* | (2020.01) |
| *D06F 105/58* | (2020.01) |

(52) U.S. Cl.

CPC ..... *D06F 34/22* (2020.02); *D06F 23/04* (2013.01); *D06F 33/37* (2020.02); *D06F 33/38* (2020.02); *D06F 34/04* (2020.02); *D06F 34/28* (2020.02); *D06F 39/022* (2013.01); *D06F 2103/22* (2020.02); *D06F 2105/42* (2020.02); *D06F 2105/52* (2020.02); *D06F 2105/58* (2020.02)

(58) Field of Classification Search

None

See application file for complete search history.

(56) References Cited

U.S. PATENT DOCUMENTS

| | | | | |
|---|---|---|---|---|
| 7,733,097 | B2 * | 6/2010 | Schenkl | A47L 15/4297 324/693 |
| 9,334,600 | B2 | 5/2016 | Pollett et al. | |
| 9,481,957 | B2 | 11/2016 | Schulze | |
| 2010/0125364 | A1 * | 5/2010 | Ebrom | D06F 39/02 700/275 |
| 2018/0002857 | A1 * | 1/2018 | Hombroek | D06F 35/005 |
| 2018/0002859 | A1 * | 1/2018 | Hombroek | D06F 39/087 |
| 2021/0062397 | A1 * | 3/2021 | Cha | D06F 39/02 |
| 2021/0198829 | A1 * | 7/2021 | Kang | D06F 33/58 |
| 2022/0213633 | A1 * | 7/2022 | Zattin | D06F 33/38 |

FOREIGN PATENT DOCUMENTS

| | | | |
|---|---|---|---|
| DE | 4403418 | A1 | 8/1995 |

* cited by examiner

*Primary Examiner* — Cristi J Tate-Sims

(74) *Attorney, Agent, or Firm* — Dority & Manning, P.A.

(57) ABSTRACT

A method for operating a washing machine appliance includes initiating a rinse cycle of the washing machine appliance, operating a dispensing assembly to dispense wash fluid into the wash tub, obtaining a wash fluid turbidity of the wash fluid using the turbidity sensor, determining that a target volume of wash additive was added to the wash fluid based at least in part on the wash fluid turbidity, and implementing a responsive action in response to determining that the target volume of the wash additive was added to the wash fluid.

20 Claims, 6 Drawing Sheets

DETECT WASH ADDITIVES IN A WASHING MACHINE APPLIANCE

FIELD OF THE INVENTION

The present subject matter relates generally to washing machine appliances, or more specifically, to methods for using turbidity measurements to detect wash additives such as fabric softener in a washing machine appliance.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Conventional washing machine appliances have defined wash and rinse cycles based on the consumer selected cycle (e.g., Normal, Whites, Delicates, etc.) and/or the addition of options as selected by the consumer (e.g., Soil Level, Water Temp, Deep Rinse, Extra Rinse, etc.). The consumer selection of cycle with options, in combination with the fabric and load sensing utilized in many clothes washers today, will then determine the overall cycle for both wash and rinse. Accordingly, conventional washing machines provide no manner of making real-time cycle adjustments for wash and rinse cycles, e.g., based on the additives that are introduced by a consumer for washing and rinsing of their garments.

Accordingly, a washing machine appliance with improved wash and rinse performance is desirable. More specifically, a method for detecting wash and/or rinse additives in real time within a wash tub and adjusting operation for improved performance and consumer satisfaction would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a method for operating a washing machine appliance is provided including initiating a rinse cycle of the washing machine appliance, operating a dispensing assembly to dispense wash fluid into the wash tub, obtaining a wash fluid turbidity of the wash fluid using the turbidity sensor, determining that a target volume of wash additive was added to the wash fluid based at least in part on the wash fluid turbidity, and implementing a responsive action in response to determining that the target volume of the wash additive was added to the wash fluid.

In another exemplary embodiment, a washing machine appliance is provided including a wash tub positioned within a cabinet, a wash basket rotatably mounted within the wash tub and defining a wash chamber configured for receiving a load of clothes, a dispensing assembly for selectively adding wash fluid to the wash tub, the wash fluid comprising at least one of water or wash additive, a sump positioned proximate a bottom of the wash tub for collecting the wash fluid, a turbidity sensor positioned within the wash fluid, and a controller operably coupled to the dispensing assembly. The controller is configured to initiate a rinse cycle of the washing machine appliance, operate the dispensing assembly to dispense the wash fluid into the wash tub, obtain a wash fluid turbidity of the wash fluid using the turbidity sensor, determine that a target volume of wash additive was added to the wash fluid based at least in part on the wash fluid turbidity, and implement a responsive action in response to determining that the target volume of the wash additive was added to the wash fluid.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
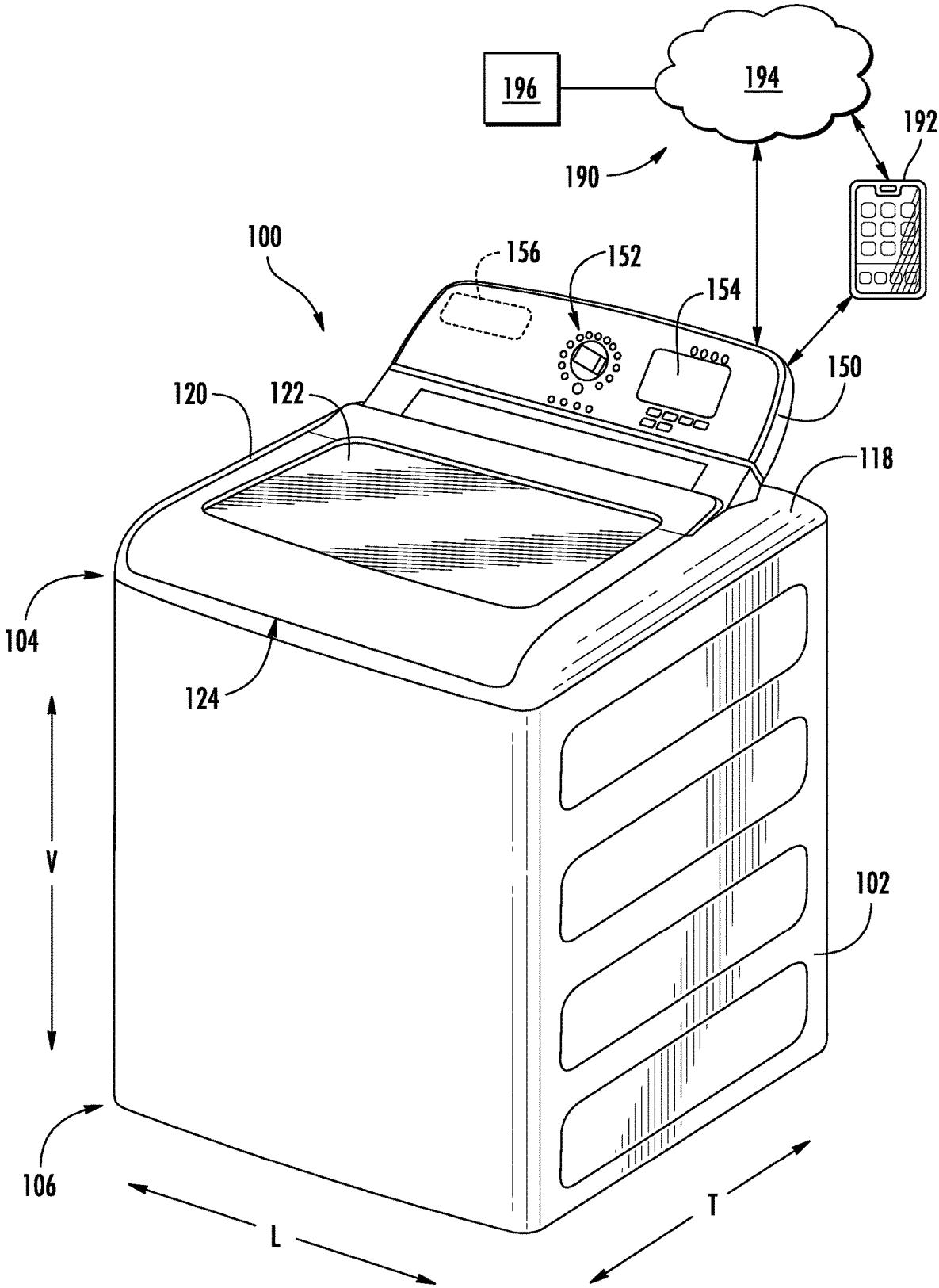
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
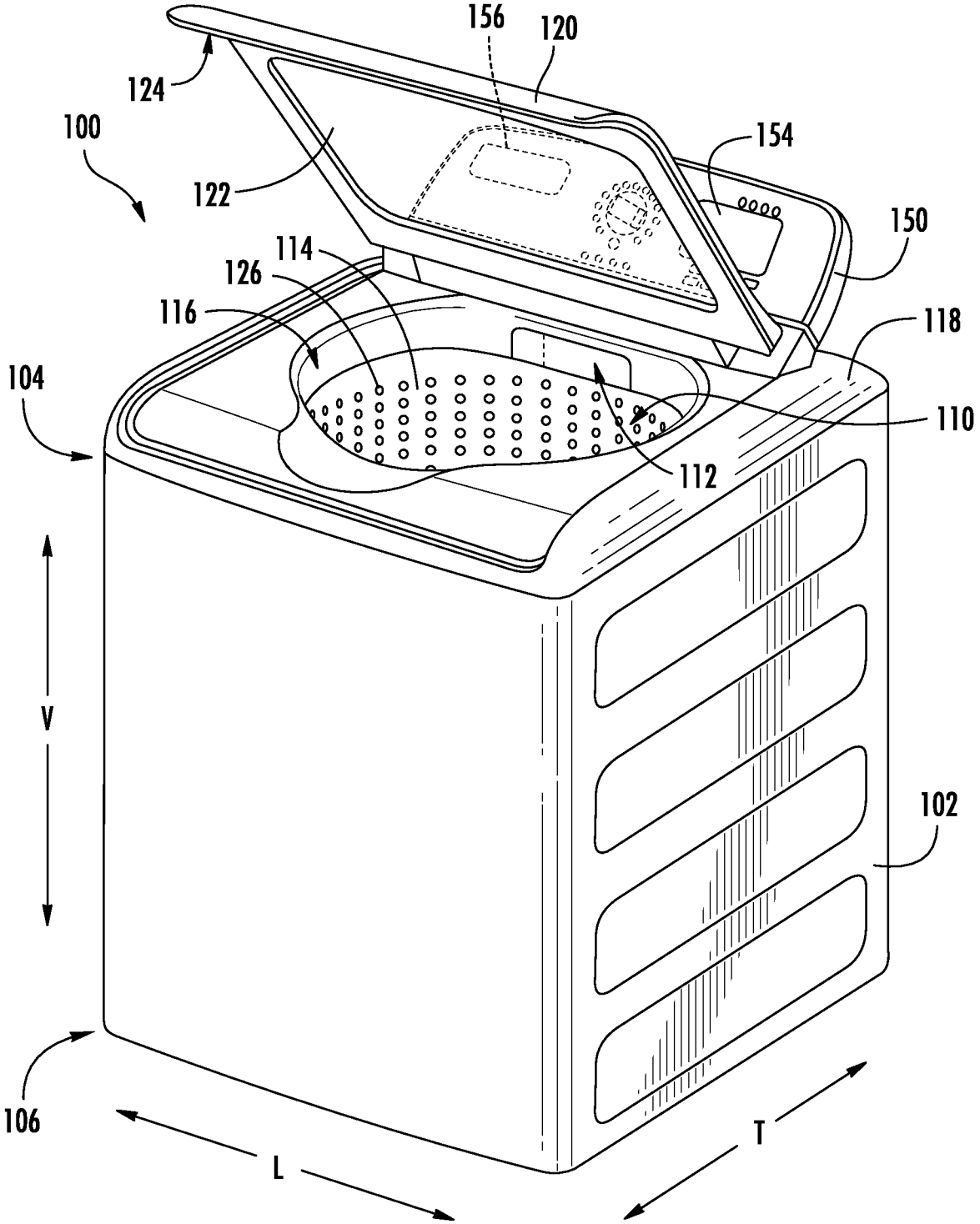
FIG. 2 provides a perspective view of the exemplary washing machine appliance of FIG. 1 with the door of the exemplary washing machine appliance shown in an open position.
Figure 3:
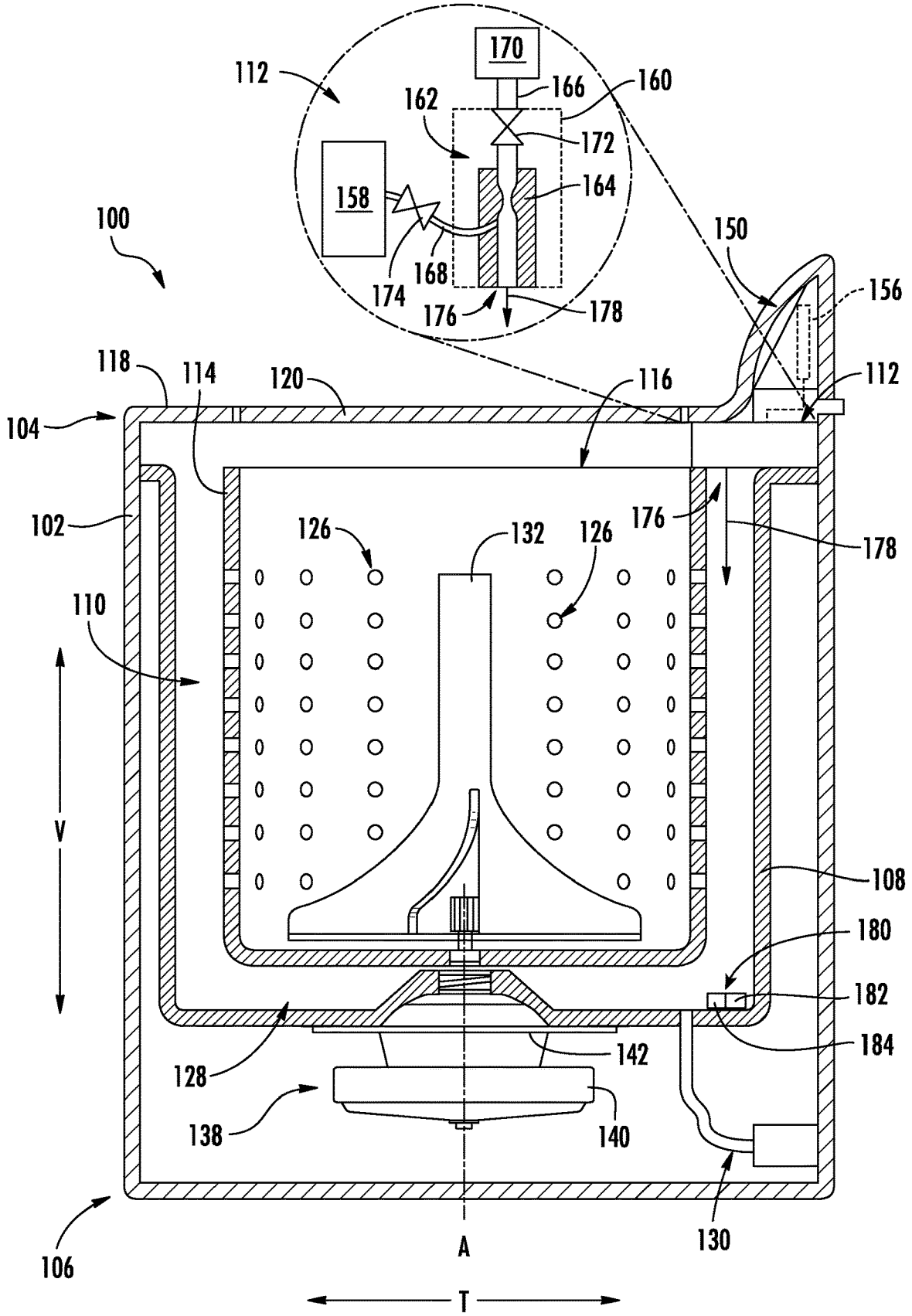
FIG. 3 provides a side cross-sectional view of the exemplary washing machine appliance of FIG. 1.

FIGS. 1 through 3 illustrate an exemplary embodiment of a vertical axis washing machine appliance 100. Specifically, FIGS. 1 and 2 illustrate perspective views of washing machine appliance 100 in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter.

Washing machine appliance 100 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 100 further includes a primary dispenser or dispensing assembly 112 (FIG. 2) for dispensing wash fluid into wash tub 108.

In addition, washing machine appliance 100 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (FIG. 2) that coincides with opening 116 of wash basket 114 to permit a user access to wash basket 114. Washing machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 100 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 100, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 100 includes a drive assembly or motor assembly 138 in mechanical communication with wash basket 114 to selectively rotate wash basket 114 (e.g., during an agitation or a rinse cycle of washing machine appliance 100). In addition, motor assembly 138 may also be in mechanical communication with agitation element 132. In this manner, motor assembly 138 may be configured for selectively rotating or oscillating wash basket 114 and/or agitation element 132 during various operating cycles of washing machine appliance 100.

More specifically, motor assembly 138 may generally include one or more of a drive motor 140 and a transmission assembly 142, e.g., such as a clutch assembly, for engaging and disengaging wash basket 114 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, motor assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by a controller or processing device 156 that is operatively coupled to control panel 150 for user manipulation to select washing machine cycles and features. In response to user manipulation of control panel 150, controller 156 operates the various components of washing machine appliance 100 to execute selected machine cycles and features. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

During operation of washing machine appliance 100, laundry items are loaded into wash basket 114 through opening 116, and washing operation is initiated through operator manipulation of input selectors 152. Wash basket 114 is filled with water and detergent and/or other fluid additives via primary dispenser 112. One or more valves can be controlled by washing machine appliance 100 to provide for filling wash tub 108 and wash basket 114 to the appropriate level for the amount of articles being washed and/or rinsed. By way of example for a wash mode, once wash basket 114 is properly filled with fluid, the contents of wash basket 114 can be agitated (e.g., with agitation element 132 as discussed previously) for washing of laundry items in wash basket 114.

After completion of the agitation cycle, washing machine appliance 100 may perform one or more rinse cycles. Specifically, according to an example embodiment, drain pump assembly 130 may drain the wash fluid from wash tub 108 and dispensing assembly 112 may dispense fresh water and/or a wash additive (such as fabric softener) into the wash tub. The load of clothes may then be agitated in the fresh water, e.g., to remove soil and detergent from load of clothes. After completion of the rinse cycle(s), drain pump assembly 130 may drain wash tub 108 and a spin cycle may be used to extract water from the clothes before the wash cycle is concluded.

Referring again to FIGS. 2 and 3, dispensing assembly 112 of washing machine appliance 100 will be described in more detail. As explained briefly above, dispensing assembly 112 may generally be configured to dispense wash fluid to facilitate one or more operating cycles or phases of an operating cycle (e.g., such as a wash cycle or a rinse cycle). The terms "wash fluid" and the like may be used herein to generally refer to a liquid used for washing and/or rinsing clothing or other articles. For example, the wash fluid is typically made up of water that may include other additives such as detergent, fabric softener, bleach, or other suitable treatments (including combinations thereof). More specifically, the wash fluid for a wash cycle may be a mixture of water, detergent, and/or other additives, while the wash fluid for a rinse cycle may be water only and/or additional rinse additives.

As best shown schematically in FIG. 3, dispensing assembly 112 may generally include a bulk storage tank or bulk reservoir 158 and a dispenser box 160. More specifically, bulk reservoir 158 may be positioned under top panel 118 and defines an additive reservoir for receiving and storing wash additive. More specifically, according to the illustrated embodiment, bulk reservoir 158 may contain a bulk volume of wash additive (such as detergent or other suitable wash additives) that is sufficient for a plurality of wash cycles of washing machine appliance 100, such as no less than twenty wash cycles, no less than fifty wash cycles, etc. As a particular example, bulk reservoir 158 is configured for containing no less than twenty fluid ounces, no less than three-quarters of a gallon, or about one gallon of wash additive.

As will be described in detail below, dispensing assembly 112 may include features for drawing wash additive from bulk reservoir 158 and mixing it with water prior to directing the mixture into wash tub 108 to facilitate a cleaning operation. By contrast, dispensing assembly 112 is also capable of dispensing water only. Thus, dispensing assembly 112 may automatically dispense the desired amount of water with or without a desired amount of wash additive such that a user can avoid filling dispenser box 160 with detergent before each operation of washing machine appliance 100.

For example, as best shown in FIG. 3, washing machine appliance 100 includes an aspirator assembly 162, which is a Venturi-based dispensing system that uses a flow of water to create suction within a Venturi tube to draw in wash additive from bulk reservoir 158 which mixes with the water and is dispensed into wash tub 108 as a concentrated wash fluid preferably having a target volume of wash additive. After the target volume of wash additive is dispensed into wash tub 108, additional water may be provided into wash tub 108 as needed to fill to the desired wash volume. It should be appreciated that the target volume may be pre-programmed in controller 156 according to the selected operating cycle or parameters, may be set by a user, or may be determined in any other suitable manner.

As illustrated, aspirator assembly 162 includes a Venturi pump 164 that is fluidly coupled to both a water supply conduit 166 and a suction line 168. As illustrated, water supply conduit 166 may provide fluid communication between a water supply source 170 (such as a municipal water supply) and a water inlet of Venturi pump 164. In addition, washing machine appliance 100 includes a water fill valve or water control valve 172 which is operably coupled to water supply conduit 166 and is communicatively coupled to controller 156. In this manner, controller 156 may regulate the operation of water control valve 172 to regulate the amount of water that passes through aspirator assembly 162 and into wash tub 108.

In addition, suction line 168 may provide fluid communication between bulk reservoir 158 and Venturi pump 164 (e.g., via a suction port defined on Venturi pump 164). Notably, as a flow of water is supplied through Venturi pump 164 to wash tub 108, the flowing water creates a negative pressure within suction line 168. This negative pressure may draw in wash additive from bulk reservoir 158. When certain conditions exist, the amount of wash additive dispensed is roughly proportional to the amount of time water is flowing through Venturi pump 164.

Referring still to FIG. 3, aspirator assembly 162 may further include a suction valve 174 that is operably coupled to suction line 168 to control the flow of wash additive through suction line 168 when desired. For example, suction valve 174 may be a solenoid valve that is communicatively coupled with controller 156. Controller 156 may selectively open and close suction valve 174 to allow wash additive to flow from bulk reservoir 158 through additive suction valve 174. For example, during a rinse cycle where only water is desired, suction valve 174 may be closed to prevent wash additive from being dispensed through suction valve 174. In some embodiments, suction valve 174 is selectively controlled based on at least one of the selected wash cycle, the soil level of the articles to be washed, and the article type. According to still other embodiments, no suction valve 174 is needed at all and alternative means for preventing the flow of wash additive may be used or other water regulating valves may be used to provide water into wash tub 108.

Washing machine appliance 100, or more particularly, dispensing assembly 112, generally includes a discharge nozzle 176 for directing a flow of wash fluid (e.g., identified herein generally by reference numeral 178) into wash tub 108. In this regard, discharge nozzle 176 may be positioned above wash tub 108 proximate a rear of opening 116 defined through top panel 118. Dispensing assembly 112 may be regulated by controller 156 to discharge wash fluid 178 through discharge nozzle 176 at the desired flow rates, volumes, and/or detergent concentrations to facilitate various operating cycles, e.g., such as wash or rinse cycles.

Although water supply conduit 166, water supply source 170, discharge nozzle 176, and water control valve 172 are all described and illustrated herein in the singular form, it should be appreciated that these terms may be used herein generally to describe a supply plumbing for providing hot and/or cold water into wash chamber 110. In this regard, water supply conduit 166 may include separate conduits for receiving hot and cold water, respectively. Similarly, water supply source 170 may include both hot- and cold-water supplies regulated by dedicated valves. In addition, washing machine appliance 100 may include one or more pressure sensors (not shown) for detecting the amount of water and or clothes within wash tub 108. For example, the pressure sensor may be operably coupled to a side of wash tub 108 for detecting the weight of wash tub 108, which controller 156 may use to determine a volume of water in wash chamber 110 and a subwasher load weight.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle and/or after the rinse cycle in order to wring wash fluid from the articles being washed. During a spin cycle, wash basket 114 is rotated at relatively high speeds to help wring fluid from the laundry articles through perforations 126. During or prior to the spin cycle, drain pump assembly 130 may operate to discharge wash fluid from wash tub 108, e.g., to an external drain. After articles disposed in wash basket 114 are cleaned and/or washed, the user can remove the articles from wash basket 114, e.g., by reaching into wash basket 114 through opening 116.

Referring now specifically to FIG. 3, washing machine appliance 100 may include a sensor assembly 180 that includes one or more sensors for providing useful information regarding a particular load or operating cycle of the appliance. This information may be used for improved appliance performance, as described in more detail herein. For example, sensor assembly 180 may include a turbidity sensor 182, e.g., for monitoring the contaminant level or soil level of wash fluid 178, e.g., in order to determine the cleanliness of the clothes or to determine appropriate rinse parameters.

According to the illustrated embodiment, sensor assembly 180 and turbidity sensor 182 may be mounted within sump 128 where it is capable of obtaining accurate reading of wash fluid 178 within wash tub 108. According to still other embodiments, turbidity sensor 182 may alternatively be positioned within a drain line or in drain pump assembly 130, within a recirculation line or assembly, or at any other location where it is in contact with collected wash fluid 178.

According to an example embodiment, turbidity sensor 182 may operate by using an emitter to emit a beam of light that is passed through wash fluid 178 and detecting the beam of light using a receiver. In this manner, the turbidity of wash fluid 178 may be estimated based on the distortion of the beam of light. Although turbidity sensor 182 is illustrated herein as including an emitter and receiver for generating and receiving a beam of light, it should be appreciated that this is only one exemplary embodiment. Any other suitable type or configuration of turbidity sensor may be used while remaining within the scope of the present subject matter. Other sensor configurations are possible and within the scope of the present subject matter.

In addition, sensor assembly 180 may be used to monitor the wash process using any other suitable sensors. For example, as illustrated, sensor assembly 180 may include an auxiliary sensor 184 that is positioned in sump 128 and is configured for monitoring other suitable parameters or conditions of the wash fluid 178. For example, auxiliary sensor 184 may be a conductivity sensor for measuring the electrical conductivity of the wash fluid 178. In addition, or alternatively, auxiliary sensor 184 may be a pH sensor for measuring the pH of the wash fluid 178. The conductivity and pH may be related to the conditions of the wash fluid 178 and may be used to facilitate an improved rinse cycle, as described herein with respect to the use of turbidity measurements.

Referring still to FIG. 1, a schematic diagram of an external communication system 190 will be described according to an exemplary embodiment of the present subject matter. In general, external communication system 190 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 190 may be used to transfer data or other information to improve performance of one or more external devices or appliances and/or improve user interaction with such devices.

For example, external communication system 190 permits controller 156 of washing machine appliance 100 to communicate with a separate device external to washing machine appliance 100, referred to generally herein as an external device 192. As described in more detail below, these communications may be facilitated using a wired or wireless connection, such as via a network 194. In general, external device 192 may be any suitable device separate from washing machine appliance 100 that is configured to provide and/or receive communications, information, data, or commands from a user. In this regard, external device 192 may be, for example, a personal phone, a smartphone, a tablet, a laptop or personal computer, a wearable device, a smart home system, or another mobile or remote device.

In addition, a remote server 196 may be in communication with washing machine appliance 100 and/or external device 192 through network 194. In this regard, for example, remote server 196 may be a cloud-based server 196, and is thus located at a distant location, such as in a separate state, country, etc. According to an exemplary embodiment, external device 192 may communicate with a remote server 196 over network 194, such as the Internet, to transmit/receive data or information, provide user inputs, receive user notifications or instructions, interact with or control washing machine appliance 100, etc. In addition, external device 192 and remote server 196 may communicate with washing machine appliance 100 to communicate similar information.

In general, communication between washing machine appliance 100, external device 192, remote server 196, and/or other user devices or appliances may be carried using any type of wired or wireless connection and using any suitable type of communication network, non-limiting examples of which are provided below. For example, external device 192 may be in direct or indirect communication with washing machine appliance 100 through any suitable wired or wireless communication connections or interfaces, such as network 194. For example, network 194 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machine appliances. In addition, aspects of the present subject matter may be utilized in a combination washer/dryer appliance.

According to example embodiments, it may be advantageous for the washing machine appliance 100 to automatically adjust the rinse cycle when the presence of a rinse additive, such as fabric softener, laundry sanitizer, or another rinse agent, may be detected within the rinse fluid during the rinse cycle. For instance, a rinse additive may typically be added to the rinse fluid to remove odors, help fight wrinkles, prevent static cling, soften garments, and sanitize articles, among other uses, during the rinse cycle. In such instances, longer rinse cycles or multiple rinse cycles, and/or a water volume adjustment, may be utilized to improve the overall performance of the rinse cycle. According to example embodiments, less water and rinse time may be used for rinse cycles that are performed without, e.g., to save on energy and water usage. By contrast, more water and longer agitation time may be used for rinse cycles that are performed with fabric softener, e.g., for proper dispersion into solution and to prevent spotting.

Now that the construction of washing machine appliance 100 and the configuration of controller 156 according to exemplary embodiments have been presented, an exemplary method 200 of operating a washing machine appliance will be described. Specifically, method 200 may be used to perform a rinse cycle of a washing machine appliance, such as the washing machine appliance 100. Although the discussion below refers to the exemplary method 200 of operating washing machine appliance 100, one skilled in the art will appreciate that the exemplary method 200 is applicable to the operation of a variety of other washing machine appliances, such as horizontal axis washing machine appliances. In exemplary embodiments, the various method steps as disclosed herein may be performed by controller 156 or a separate, dedicated controller.

Specifically, method 200 includes, at step 210, initiating a rinse cycle of a washing machine appliance. In this regard, continuing the example from above, controller 156 of washing machine appliance 100 may initiate a rinse cycle, e.g., by draining wash fluid remaining within the wash tub 108 after the wash/agitation cycle, operating dispensing assembly 112 to supply fresh water into wash tub 108, and performing a rinse cycle using predetermined cycle parameters. According to example embodiments, the rinse cycle parameters may be predetermined, e.g., based on the load type, load size, load sensing results, user inputs, etc. For example, predefined rinse cycles may include a standard rinse cycle, a deep rinse cycle, etc.

Step 220 may include operating a dispensing assembly of a washing machine appliance to perform an initial fill process using an initial water volume. Specifically, this initial fill process may include adding a small volume of wash fluid to wash tub 108 (e.g., small relative to the target fill volume for performing the rinse cycle). According to example embodiments, the wash fluid added at step 220 may be fresh water, e.g., with no rinse additives included. As will be explained in more detail below, the turbidity of this fresh water may be used as a baseline for determining whether wash additive (e.g., fabric softener) has been added during a rinse cycle. Notably, it may be desirable to submerge the turbidity sensor 182 such that the sensor may operate properly and accurately detect the turbidity of the wash fluid in wash tub 108. Accordingly, step 220 includes dispensing a sufficient volume of wash fluid for submerging turbidity sensor 182. For example, step 220 may include dispensing ½ of a gallon, one gallon, 2 gallons, 4 gallons, or more of water into wash tub 108.

Step 230 may include obtaining a baseline turbidity of the initial water volume using a turbidity sensor, e.g., such as turbidity sensor 182. According to example embodiments, the "baseline" turbidity reading may be the turbidity of fresh water. According to still other embodiments, step 230 may be omitted, and the baseline turbidity may be programmed by the user, set by the manufacturer, or determined in any other suitable manner.

Step 240 may include operating a dispensing assembly to dispense wash fluid into a wash tub of a washing machine appliance. For example, using washing machine appliance 100 as an example, the rinse cycle may include operating dispensing assembly 112 to add wash fluid (e.g., water, detergent, and/or other additives) into wash tub 108. According to an example embodiment, step 240 may include adding wash fluid that includes water and a wash additive (e.g., such as fabric softener).

Figure 5:
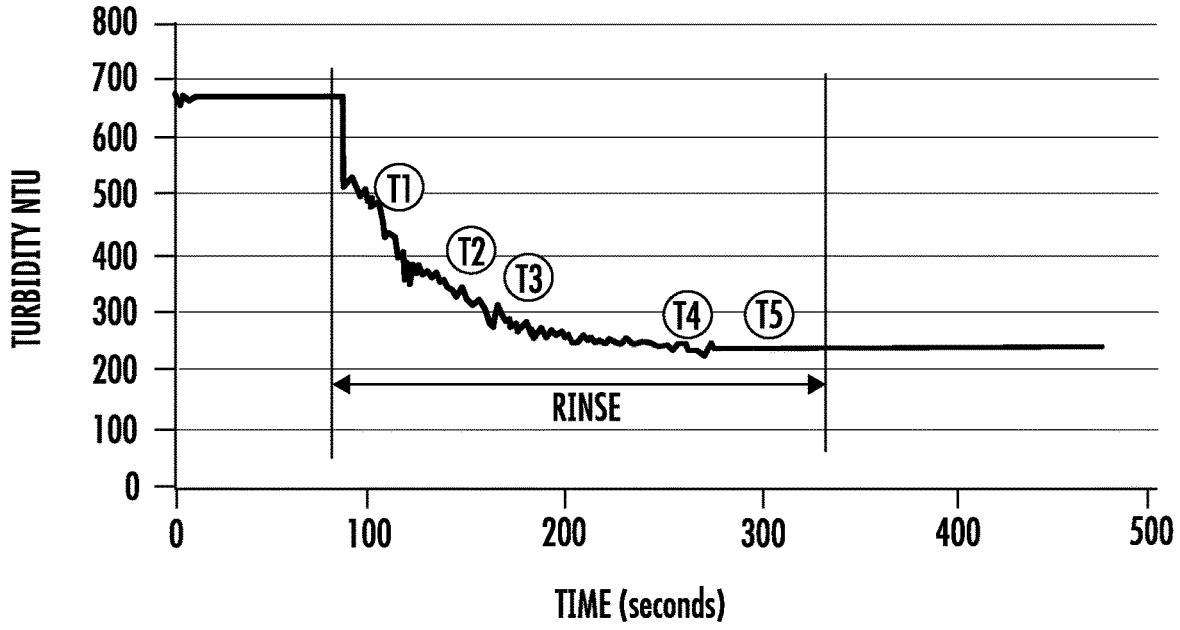
FIG. 5 is a plot of a measured turbidity of wash fluid during a rinse cycle where no fabric softener is added according to an example embodiment of the present subject matter.
Figure 6:
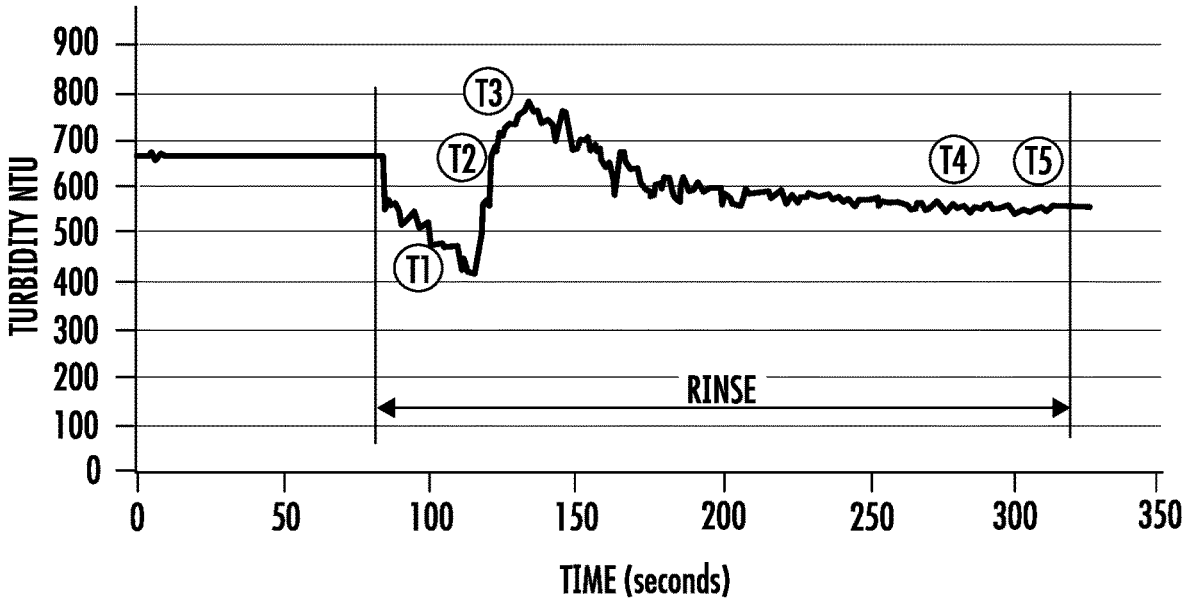
FIG. 6 is a plot of a measured turbidity of wash fluid during a rinse cycle where fabric softener is added according to an example embodiment of the present subject matter.

Step 250 may generally include obtaining a wash fluid turbidity of the wash fluid using a turbidity sensor. In this regard, turbidity sensor 182 may be used to measure the turbidity of wash fluid within wash tub 108 throughout the rinse cycle. In this regard, referring for example to FIGS. 5 and 6, the turbidity readings in Nephelometric Turbidity Units (NTUs) over the course of two rinse cycles are illustrated. More specifically, FIG. 5 illustrates the measured turbidity of wash fluid during a rinse cycle where no fabric softener is added and FIG. 6 illustrates the measured turbidity of wash fluid during a rinse cycle where fabric softener is added. As will be explained in more detail below, identifying patterns in these turbidity reading may be used to determine whether an additive has been added or a volume of the additive that has been added. Using this information, rinse cycle parameters may be changed in order to improve rinse performance.

Step 260 may include determining that a target volume of wash additive was added to the wash fluid based at least in part on the wash fluid turbidity. In this regard, controller 156 may be programmed to monitor the turbidity of wash fluid and use the turbidity to decide whether a wash additive has been added, whether the wash fluid is freshwater only, how much wash additive was added, the type of wash additive added, or other suitable information. According to example embodiments, this determination may be made solely on the measured turbidity at a specific point during the rinse cycle. According to still other embodiments, this determination may be made based on comparison with a previously measured turbidity, as described in more detail below.

Specifically, according to an example embodiment, determining that the target volume of wash additive was added to the wash fluid may include determining that the wash fluid turbidity exceeds a predetermined minimum threshold. According to alternative embodiments, method 200 may further include determining that the target volume of wash additive was not added to the wash fluid, e.g., by determining that the wash fluid turbidity falls below the predetermined minimum threshold. In this regard, controller 156 may be programmed with a predetermined minimum threshold above which it may be assumed that freshwater and rinse additive are present within wash tub 108. In this regard, for example, the turbidity of freshwater may be approximately 1 to 2 NTUs, in which case the minimum turbidity threshold may be set near that range, e.g., approximately 5 NTUs, 10 NTUs, etc.

According to still other embodiments, determining that the target volume of wash additive was added to the wash fluid may be based on the comparison with a baseline turbidity measurement, e.g., as obtained at step 230. In this regard, for example, the turbidity of fresh water may be obtained immediately after adding a target volume of water into wash tub 108, e.g., such as 1 gallon of water. According to example embodiments, the baseline turbidity reading may be obtained prior to agitating the load of clothes, e.g., to prevent soils or detergent from the wash cycle or remaining within the clothes from affecting the baseline turbidity reading.

Step 260 of determining that the target volume of the wash additive was added to the wash fluid may include determining that the difference between the wash fluid turbidity and the baseline turbidity exceeds a predetermined turbidity threshold. In this regard, the addition of a wash additive such as fabric softener may tend to increase the turbidity of the wash fluid in wash tub 108 (e.g., as shown in FIG. 6). This turbidity difference may generally be quantified as a mathematical difference between the measured turbidities, as a ratio of the measured turbidities, or using any other suitable mathematical quantification or relationship.

According to example embodiments, controller 156 may be programmed with the predetermined turbidity threshold and may operate dispensing assembly 112 to add wash additive. If the turbidity changes by more than the predetermined turbidity threshold, controller 156 may determine that wash additive was added. By contrast, if the turbidity does not change by more than the predetermined turbidity threshold, controller 156 may determine that wash additive was not added (or an insufficient amount of wash additive was added). According to example embodiments, the predetermined turbidity threshold may be 50 NTUs, 100 NTUs, 200 NTUs, 500 NTUs, or any other suitable turbidity value. Although step 260 is described herein as using a single threshold to determine whether or not wash additive was added, it should be appreciated that method 200 may further include determining how much or what type of wash additive was added based on turbidity changes. In addition, there could also be multiple readings of turbidity compared back to a baseline or there could be an average of multiple readings compared to a baseline.

Referring now specifically to FIGS. 5 and 6, reference numerals T1-T5 are used to identify several significant data points in each rinse cycle. Specifically, T1 marks the end of the initial fill process where the turbidity sensor is "primed" (e.g., step 220), T2 marks the duration of the wash additive dispensing (e.g., step 240), and T3 marks the end of the wash additive dispensing (e.g., the time to fully empty the fabric softener). Notably, once the wash additive is added, fresh water is added to the target volume for the rinse cycle. Reference numeral T4 marks the end of this rinse fill period. Finally, T5 marks the end of agitation. As shown in FIG. 5, no wash additive was added to the wash fluid, so the continuous adding of water further reduces the turbidity. By contrast, wash additive was added in FIG. 6, resulting in a spike in the turbidity between T1 and T3. This difference may be the turbidity difference discussed herein.

Step 270 may generally include implementing a responsive action in response to determining that the target volume of the wash additive was added to the wash fluid. In this regard, controller 156 may make parameter changes to the rinse cycle based on the turbidity readings and the determination at step 260. According to an example embodiment, if step 260 results in a determination that the target amount of wash additive was not added, controller 156 may make no changes and initiate the standard rinse cycle (e.g., a rinse cycle that minimizes or reduces water usage). If the target volume of wash additive was added, method 200 may include adjusting rinse parameters relative to a standard rinse cycle. For example, adjusting the rinse parameters relative to the standard rinse cycle may include initiating a deep rinse cycle, the deep rinse cycle including at least one of adding more water, agitating longer, implementing of a soaking process, or performing multiple rinse cycles.

Implementing the responsive action in response to determining that the target volume of wash additive was added may further include providing a user notification that the target volume of wash additive was added. For example, this user notification may be provided through a control panel 150, e.g., via display 154. According to still other embodiments, the user notification may be provided to a remote device 192 (e.g., such as a user's cell phone) using network 194.

Figure 7:
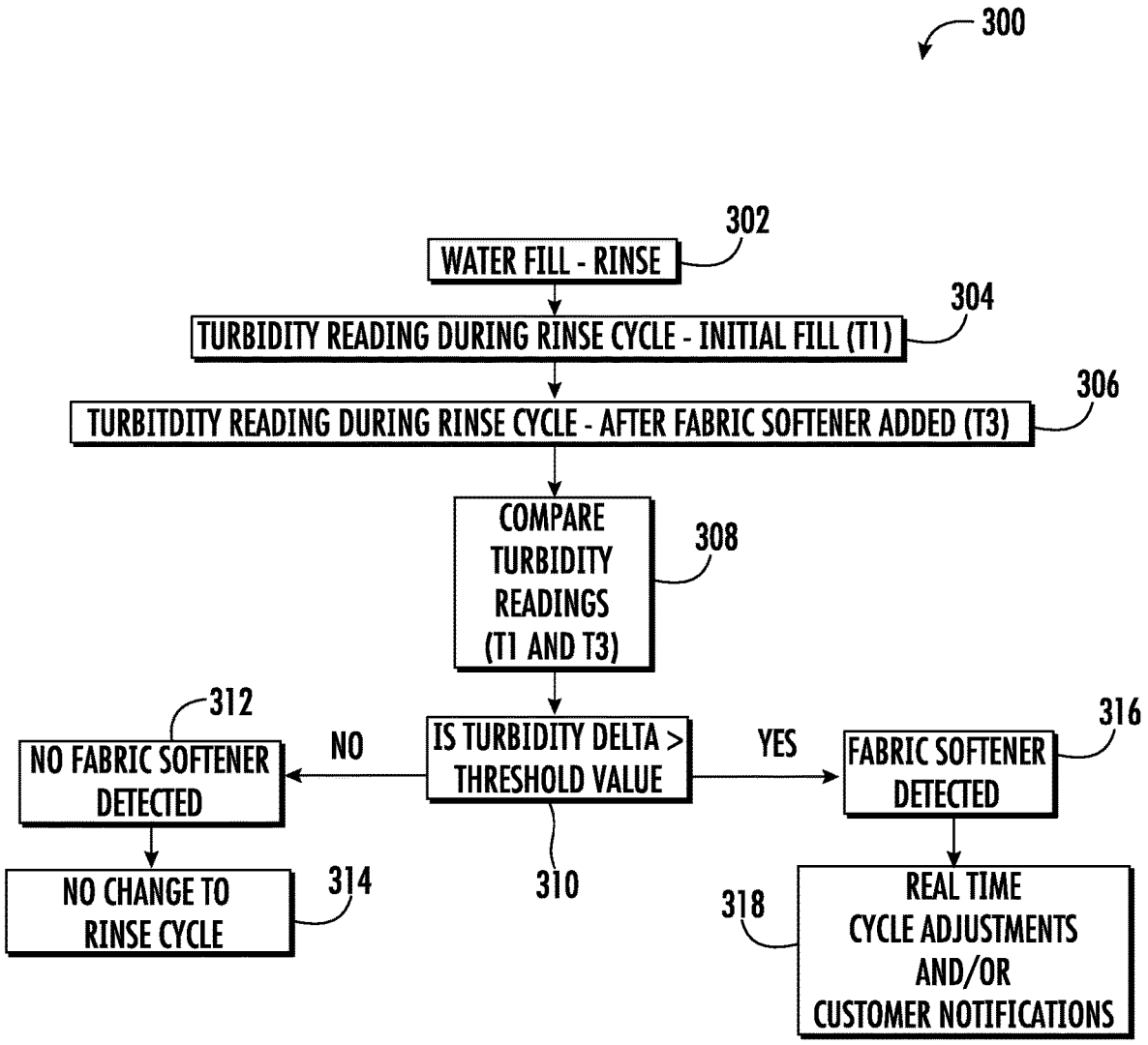
FIG. 7 provides a flow diagram of an exemplary process for implementing a turbidity-based wash cycle in a washing machine appliance according to an exemplary embodiment of the present subject matter.

Referring now briefly to FIG. 7, an exemplary flow diagram of a smart rinse cycle 300 that may be implemented by washing machine appliance 100 will be described according to an exemplary embodiment of the present subject matter. According to exemplary embodiments, method 300 may be similar to or interchangeable with method 200 and may be implemented by controller 156 of washing machine appliance 100. As shown, at step 302, a rinse cycle may be initiated when the wash fluid has been drained after a prior wash/agitation cycle, and an initial fill process may be performed by supplying only water into wash tub 108. Step 304 may include obtaining a turbidity reading during or after the initial fill cycle. This turbidity reading may be referred to as the "baseline" turbidity reading and may be the turbidity of fresh water.

Step 306 may include obtaining a second turbidity reading after a wash additive (e.g., fabric softener) has been added (or should have been added). The second turbidity reading may be referred to herein as the wash fluid turbidity reading and can represent the turbidity of wash fluid after wash additive has been added to the fresh water. Step 308 may include comparing the baseline and wash fluid turbidity readings to determine whether the target volume of wash additive has been added to wash tub 108. Specifically, step 310 may include determining whether a difference between the baseline and wash fluid turbidity measurements is greater than a predetermined threshold. If the turbidity difference is less than the threshold, step 312 may include determining that no wash additive was detected and step 314 may include performing a standard rinse cycle with no modifications. If the turbidity difference exceeds the threshold, step 316 may include determining that wash additive is present in the wash fluid and step 318 may include making rinse parameter adjustments to account for the presence of wash additive and/or providing user notifications.

Figure 4:
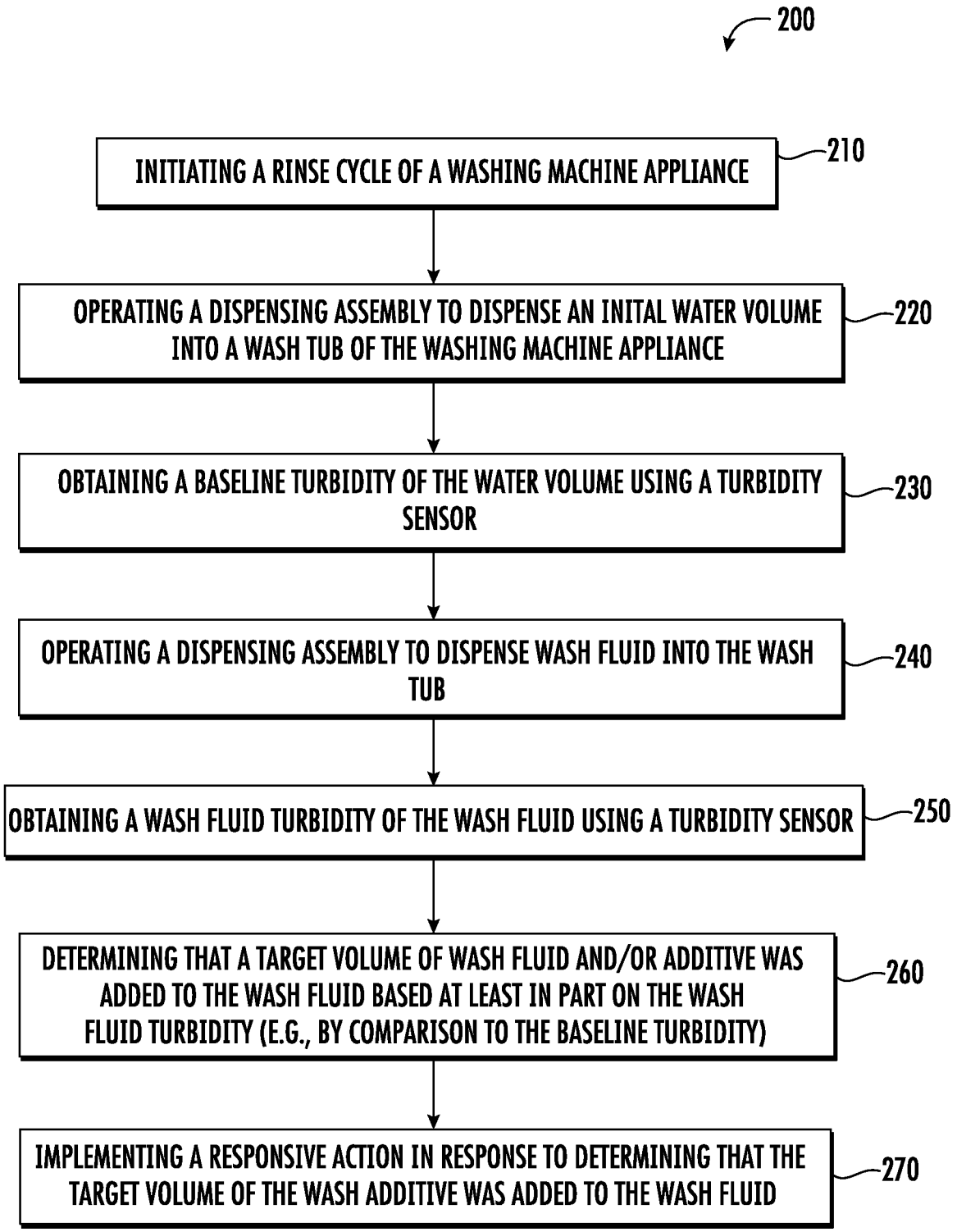
FIG. 4 illustrates a method for operating a washing machine appliance in accordance with one embodiment of the present disclosure.

FIGS. 4 and 7 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 and method 300 are explained using washing machine appliance 100 as an example, it should be appreciated that this method may be applied to the operation of any suitable laundry appliance, such as another washing machine appliance.

As explained above, aspects of the present subject matter are directed to a washing machine appliance that includes a turbidity sensor located in the bottom of the wash tub in contact with the wash fluid. The turbidity sensor may be used to detect the presence of fabric softener (or other wash additives) in the wash tub during the rinse cycle. For example, a baseline reading of clean water may be taken when the sensor is submerged at the start of the rinse cycle. Subsequently, another reading may be taken after fabric softener has been added to the rinse water. By comparing these two turbidity readings, the washing machine can determine if fabric softener has been detected, enabling it to adjust the cycle for optimal performance. Furthermore, notifications regarding the rinse cycle can be sent to the user.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the washing machine appliance comprising a wash tub positioned within a cabinet, a dispensing assembly for selectively adding wash fluid to the wash tub, and a turbidity sensor positioned within the wash fluid, the method comprising:

initiating a rinse cycle of the washing machine appliance;

operating a dispensing assembly to dispense wash fluid into the wash tub;

obtaining a wash fluid turbidity of the wash fluid using the turbidity sensor;

determining a volume of wash additive was added to the wash fluid based at least in part on the wash fluid turbidity; and implementing a responsive action in response to determining the volume of the wash additive was added to the wash fluid.

2. The method of claim 1, wherein determining the volume of wash additive was added to the wash fluid based at least in part on the wash fluid turbidity comprises:

determining that the wash fluid turbidity exceeds a predetermined minimum threshold.

3. The method of claim 1, further comprising:

obtaining a baseline turbidity of the wash fluid prior to adding the wash additive.

4. The method of claim 3, wherein obtaining the baseline turbidity of the wash fluid prior to adding the wash additive comprises:

operating the dispensing assembly to dispense about one gallon of water; and obtaining the baseline turbidity of the water using the turbidity sensor.

5. The method of claim 3, wherein determining the volume of wash additive was added to the wash fluid based at least in part on the wash fluid turbidity comprises:

determining that a difference between the wash fluid turbidity and the baseline turbidity exceeds a predetermined turbidity threshold.

6. The method of claim 5, wherein the predetermined turbidity threshold is about 100 Nephelometric Turbidity Units (NTUs).

7. The method of claim 1, wherein the wash fluid turbidity is obtained immediately after adding the wash additive and prior to agitation.

8. The method of claim 1, wherein implementing the responsive action in response to determining the volume of the wash additive was added to the wash fluid comprises:

adjusting rinse parameters relative to a standard rinse cycle.

9. The method of claim 8, wherein adjusting the rinse parameters relative to the standard rinse cycle comprises:

initiating rinse cycle adjustments comprising at least one of adding more water, agitating longer, implementation of a soaking process, or performing multiple rinse cycles.

10. The method of claim 1, further comprising:

determining that the wash additive was not added to the wash fluid based at least in part on the wash fluid turbidity; and performing a standard rinse cycle.

11. The method of claim 1, wherein implementing the responsive action in response to determining the volume of the wash additive was added to the wash fluid comprises:

providing a user notification the volume of the wash additive was added to the wash fluid.

12. The method of claim 11, wherein the user notification is provided through a user interface panel of the washing machine appliance.

13. The method of claim 11, wherein the user notification is provided to a remote device using an external network.

14. The method of claim 1, wherein the wash additive is fabric softener.

15. A washing machine appliance, comprising:

a wash tub positioned within a cabinet;

a wash basket rotatably mounted within the wash tub and defining a wash chamber configured for receiving a load of clothes;

a dispensing assembly for selectively adding wash fluid to the wash tub, the wash fluid comprising at least one of water or wash additive;

a sump positioned proximate a bottom of the wash tub for collecting the wash fluid;

a turbidity sensor positioned within the wash fluid; and a controller operably coupled to the dispensing assembly, the controller being configured to:

initiate a rinse cycle of the washing machine appliance;

operate the dispensing assembly to dispense the wash fluid into the wash tub;

obtain a wash fluid turbidity of the wash fluid using the turbidity sensor;

determine a target volume of wash additive was added to the wash fluid based at least in part on the wash fluid turbidity; and implement a responsive action in response to determining the volume of the wash additive was added to the wash fluid.

16. The washing machine appliance of claim 15, wherein determining the volume of wash additive was added to the wash fluid based at least in part on the wash fluid turbidity comprises:

determining that the wash fluid turbidity exceeds a predetermined minimum threshold.

17. The washing machine appliance of claim 15, wherein the controller is further configured to:

obtain a baseline turbidity of the wash fluid prior to adding the wash additive, wherein determining the volume of wash additive was added to the wash fluid based at least in part on the wash fluid turbidity comprises determining that a difference between the wash fluid turbidity and the baseline turbidity exceeds a predetermined turbidity threshold.

18. The washing machine appliance of claim 15, wherein the wash fluid turbidity is obtained immediately after adding the wash additive and prior to agitation.

19. The washing machine appliance of claim 15, wherein implementing the responsive action in response to determining the volume of the wash additive was added to the wash fluid comprises:

initiating rinse cycle adjustments comprising at least one of adding more water, agitating longer, implementation of a soaking process, or performing multiple rinse cycles.

20. The washing machine appliance of claim 15, wherein the controller is further configured to:

determine the volume of wash additive was not added to the wash fluid based at least in part on the wash fluid turbidity; and performing a standard rinse cycle.

* * * * *